US006834764B2

(12) United States Patent
Kreft et al.

(10) Patent No.: US 6,834,764 B2
(45) Date of Patent: Dec. 28, 2004

(54) ROLLER SCREEN AND METHOD FOR SORTING MATERIALS BY SIZE

(75) Inventors: Kendall Ray Kreft, Lake Stevens, WA (US); Gary John Parobeck, Carthage, NY (US)

(73) Assignee: Acrowood Corporation, Everett, WA (US)

( * ) Notice: Subject to any disclaimer, the term of this patent is extended or adjusted under 35 U.S.C. 154(b) by 148 days.

(21) Appl. No.: 10/228,170

(22) Filed: Aug. 26, 2002

(65) Prior Publication Data

US 2004/0035764 A1 Feb. 26, 2004

(51) Int. Cl.[7] ..... B07B 13/00
(52) U.S. Cl. ..... 209/673; 271/669; 271/667
(58) Field of Search ..... 209/669, 667, 209/673

(56) References Cited

U.S. PATENT DOCUMENTS

| | | | |
|---|---|---|---|
| 2,370,539 A | 2/1945 | Hodecker | 209/106 |
| 3,817,375 A | 6/1974 | Herkes | 209/106 |
| 3,848,741 A | 11/1974 | Haley et al. | 209/106 |
| 4,209,097 A | 6/1980 | Nordmark et al. | 209/668 |
| 4,452,694 A | 6/1984 | Christensen et al. | 209/672 |
| 4,903,845 A | 2/1990 | Artiano | 209/671 |
| 5,012,933 A | 5/1991 | Artiano | 209/671 |
| 5,058,751 A | 10/1991 | Artiano | 209/673 |
| 5,109,988 A | 5/1992 | Artiano | 209/673 |

FOREIGN PATENT DOCUMENTS

| | | |
|---|---|---|
| CA | 574292 | 4/1959 |
| CA | 2036571 | 12/1994 |
| CA | 1333897 | 1/1995 |
| DE | 3027651 A1 | 3/1982 |
| SU | 1227263 A1 | 4/1986 |

*Primary Examiner*—Donald P. Walsh
*Assistant Examiner*—Kaitlin Joerger
(74) *Attorney, Agent, or Firm*—Seed IP Law Group PLLC

(57) ABSTRACT

A screen roller is provided, configured to rotate as one of a plurality of rollers in a roller screen. The roller may include left hand spiral grooves formed in a first region of the surface of the roller, extending from one end of the roller toward the center, and right hand spiral grooves formed in a second region of the surface of the roller, extending from the other end of the roller toward the center of the roller. The roller may include a bumper strip around the central portion of the roller and configured to protect the roller from damage in the event the roller strikes a neighboring roller. The features on the surface of the roller may be formed on a sleeve that slides onto a shaft. The sleeve may be the length of the roller or may be one of a plurality of sleeves on the shaft.

43 Claims, 11 Drawing Sheets

ROLLER SCREEN AND METHOD FOR SORTING MATERIALS BY SIZE

BACKGROUND OF THE INVENTION

1. Field of the Invention

The present invention relates to sorting or grading materials such as wood chips by size or thickness.

2. Description of the Related Art

In the processing of woodchips preparatory to introduction to a digester, it is preferred to reprocess chips which are thicker than a predetermined thickness and to discard those chip particles which have fibers shorter than a preset minimum length or which are in the form of flakes thinner than a preset thickness, because these are considered to be poor digesting material. For purposes of the present description, the chips to be reprocessed will be called "over-thick" and the undesired chip particles and flakes will be called "fines."

Known devices and methods for separating acceptable chips from fines and over-thick chips include the use of vibrating or gyrating screens, disc screens, and oscillating bar screens. Other known devices for separating wood products are described in U.S. Pat. Nos. 5,109,988, 5,012,933 and 4,903,845. These patents describe the use of roll screens for the separation of woodchips for use in various industries. A roll screen comprises a plurality of rollers arranged parallel to one another in a screen bed. The rollers are provided with chip agitating protuberances. The protuberances may be knurls, grooves or ridges, and the rollers are rotated in the same direction so that the protuberances function to tumble and push the chips along the bed, from one roller to the next. The inter-roller dimensions, or gaps between rollers are sized to receive only the chips of proper thickness. As the rollers rotate, the acceptable chips and fines occupying the spaces between the rollers pass downwardly through the gaps into a hopper or into a discharge conveyor. The over-thick chips in the spaces between the rollers are nudged ahead by the oncoming chips and continue to be conveyed along the roller bed by the rollers for discharge from the forward end of the roller bed for reprocessing.

A second screen bed, having inter-roller dimensions selected to prevent acceptable chips from passing therebetween, is used to separate the fines from the acceptable chips.

Protuberances on the rollers may include knurls having various shapes such as pyramidal, conical, frusto-conical or frusto-pyramidal shapes. Ridges are preferably tapered and helical for the length of the rollers. Commonly, the formation of pyramidal or frusto-pyramidal knurls are formed by two helical sets of routed or machined V-grooves of opposite hand. Ridges are formed by single sets of helical grooves, either right- or left-handed. Commonly, when helical ridges are employed, the helical patterns of adjacent rollers in a roll screen alternate right-then left-handed, inasmuch as the helical groove of a rotating roller will tend to impart a lateral motion to the chips rolling across it. By alternating right-, then left-handed rollers, the chips will tend to move in a zigzag pattern as they progress down the bed of rollers.

There are several difficulties that are encountered in the employment of roller-type screens. For example, to increase the capacity of a roller screen, the length of the individual rollers can be increased. This allows material to be distributed across the entire length and permits the handling of larger volumes of material. However, as the length of the rollers increases, the possibility of contact between rollers also increases. As the rollers rotate and process material, the rollers may flex slightly. In the event that two adjacent rollers flex toward each other simultaneously, it is possible for the rollers to strike each other, resulting in damage to the knurled or grooved surfaces of the rollers. Naturally, rollers having a larger diameter will generally be more rigid than those having smaller diameters, and so, may be used to form wider beds without danger of strikes. However, the separation characteristics of rollers of different diameters vary, meaning that a screen made up of rollers of a larger diameter may be useful for sorting some kinds of chips or chip sizes, but not others. Thus, increasing the diameter of the rollers is not a universal solution.

Another difficulty encountered in roller screens is the need to maintain material evenly distributed across the width of the rollers, while preventing material from dropping off the ends of the rollers. Typically a sidewall on each side of the roll screen is provided for this purpose; however, small particles will still pass between the sidewall and the end of the roller. These particles will insinuate themselves into the drive trains and bearings of the rollers, necessitating periodic maintenance for the removal of foreign material.

The cost of the individual rollers is another consideration. As rollers are made longer and bigger, the cost of the rollers increases. Damaged rollers are more expensive to repair or replace, and the cost of maintaining a complete inventory of rollers for different applications can be prohibitive.

BRIEF SUMMARY OF THE INVENTION

According to an embodiment of the invention, a roller is provided for sorting material according to physical dimensions. The roller includes a cylindrical sleeve having a first region with left hand spiral grooves and a second region with right hand spiral grooves. The sleeve may also comprise a smooth region between the first and second regions, the smooth region having an outside diameter equal to or greater than outside diameters of the first or second regions.

According to another embodiment, a shaft is positioned within, and coaxial to, the cylindrical sleeve previously described. The shaft may be sized to fit snugly within the cylindrical sleeve, in which case the shaft is coupled to the sleeve such that the sleeve rotates with the shaft, or an outer diameter of the shaft may be substantially less than an inner diameter of the cylindrical sleeve, in which case the shaft and the cylindrical sleeve are maintained in a coaxial relationship by an intermediate spacer positioned in a space between the outer surface of the shaft and the inner surface of the sleeve. The shaft, spacer and sleeve are coupled such that rotational energy is transferred from the shaft, through the spacer to the sleeve. The shaft and sleeve together comprise a screen roller.

According to an embodiment of the invention, a screen roller is provided. The roller is configured to rotate as one of a plurality of rollers in a roller screen. The roller includes left hand spiral grooves formed in a first region of an outer surface of the roller, the first region extending longitudinally from a first end of the roller toward the center of the roller, and right hand spiral grooves formed in a second region of an outer surface of the roller, the second region extending longitudinally from a second end of the roller toward the center of the roller.

According to an embodiment of the invention, a screen roller is provided. The roller is configured to rotate as one of a plurality of rollers in a roller screen. The roller includes features on the outer surface thereof configured to agitate and screen material moving across the roller screen. A bumper strip is provided in a central region of the roller. The bumper strip comprises a smooth section of roller having a diameter sufficient that, in the event the roller flexes and strikes a neighboring roller, the bumper strip will make contact first, preventing damage to the roller or the features thereon.

An embodiment of the invention includes a roller screen having a plurality of rollers as described in one of the embodiments above.

According to an embodiment of the invention, a method is provided for screening material such as wood chips.

BRIEF DESCRIPTION OF THE SEVERAL VIEWS OF THE DRAWING(S)

In order to assist understanding of the present invention, embodiments of the invention will now be described, purely by way of non-limiting example, with reference to the attached drawings, in which.

Figure 4A:
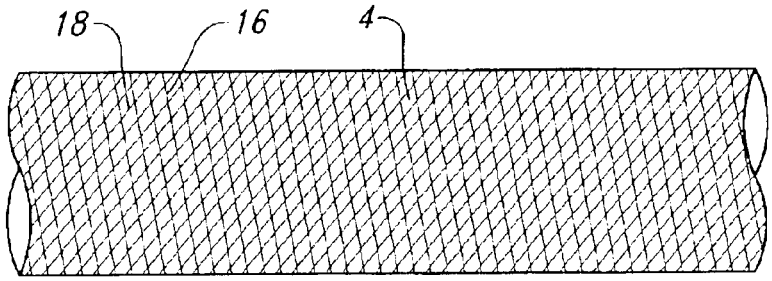
Figure 4B:
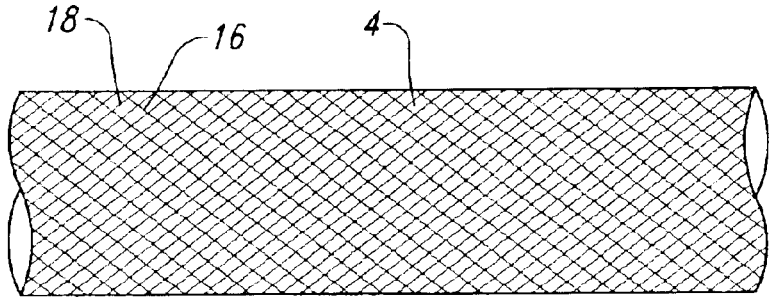
Figure 4C:
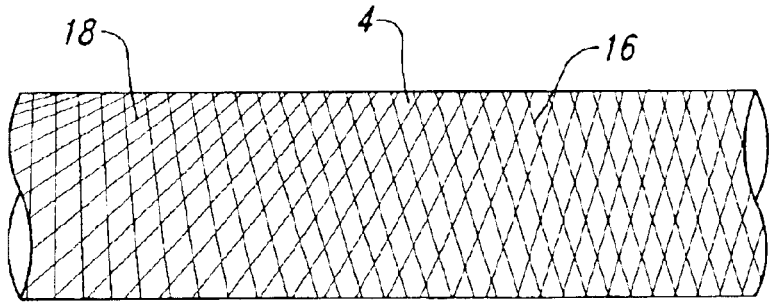
Figure 5:
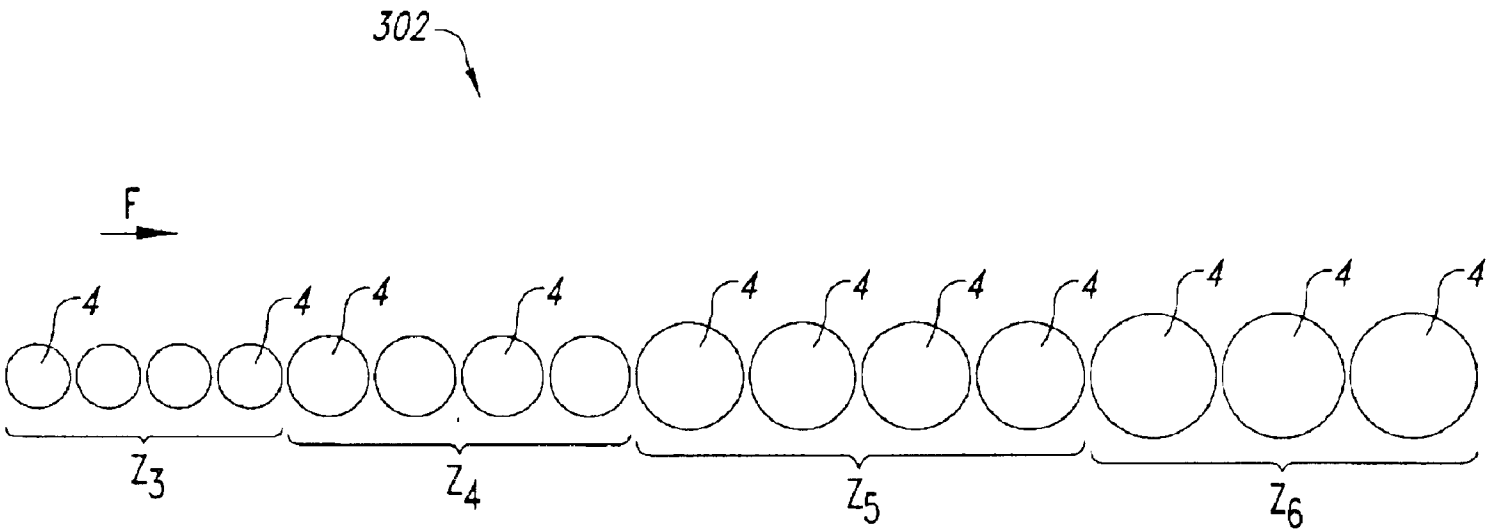
Figure 6:
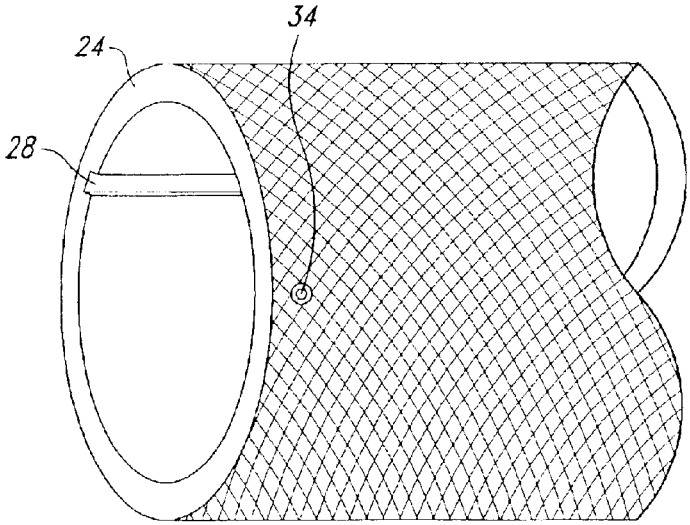
Figure 7:
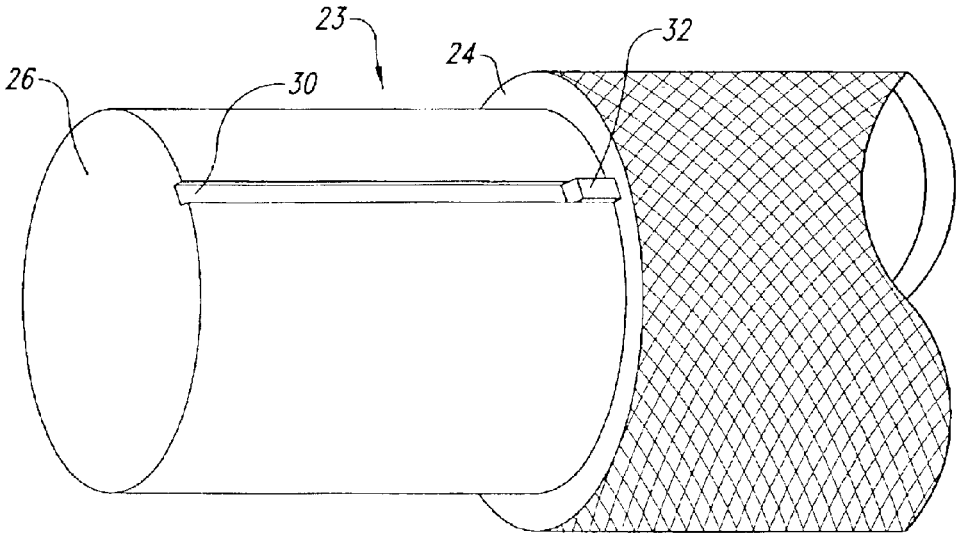
Figure 9:
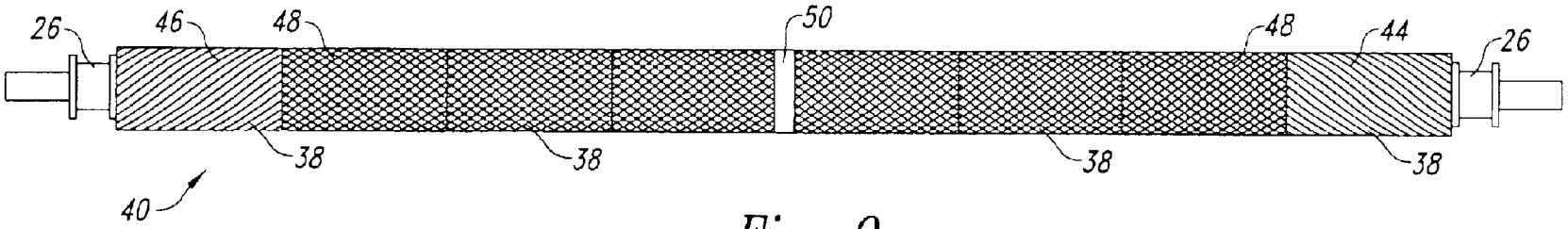
Figure 8:
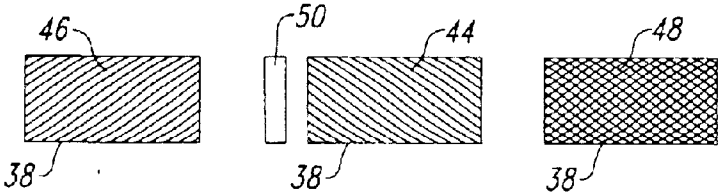
Figure 10:
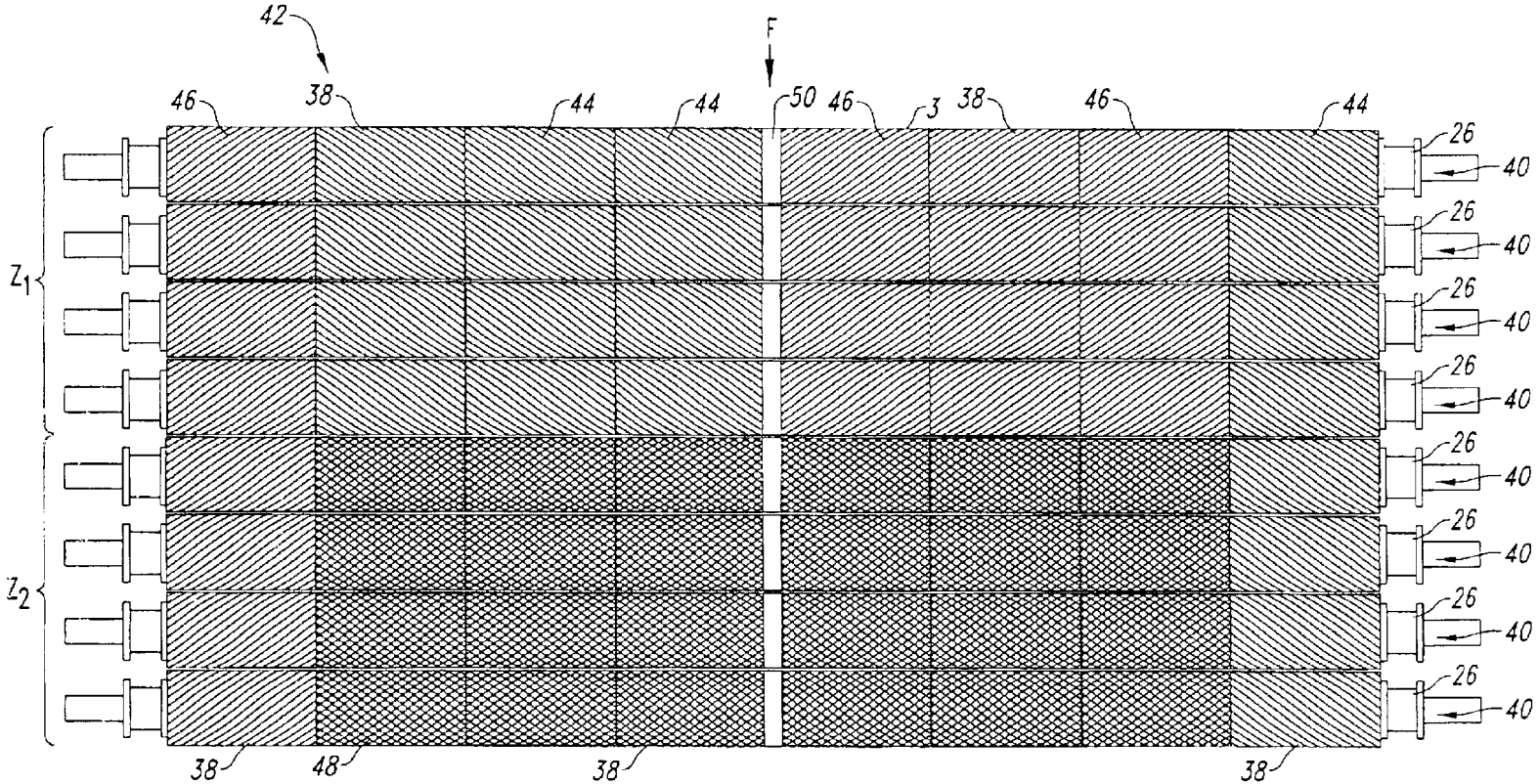
Figure 11:
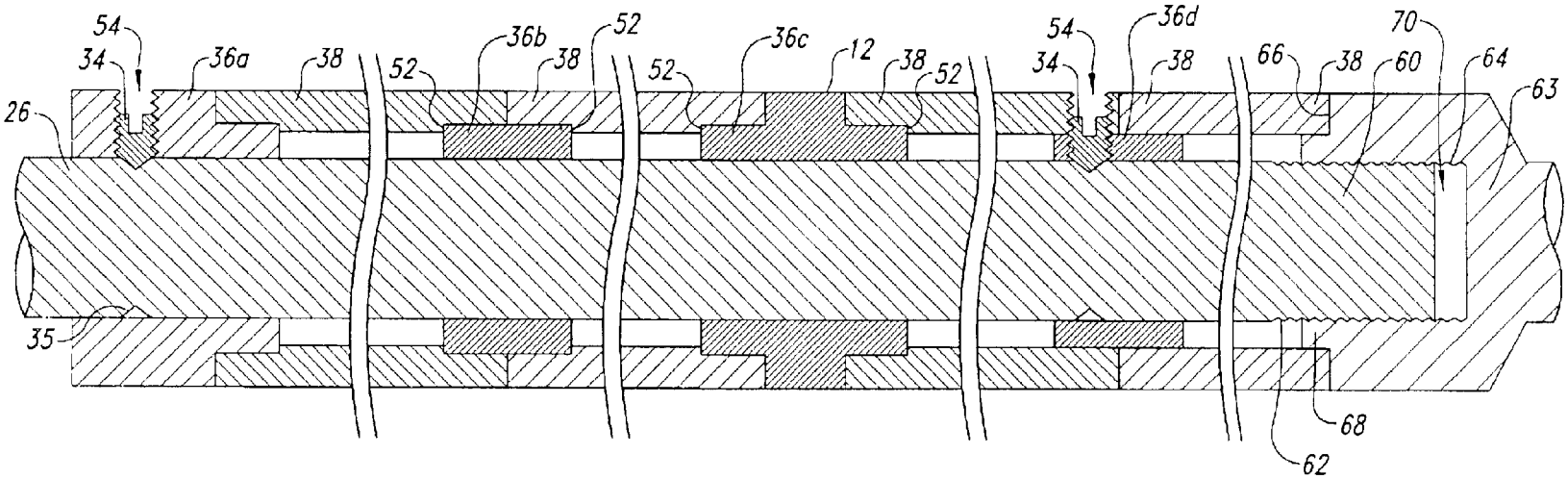

FIGS. 4A–4C schematically illustrate knurling patterns on rollers, according to embodiments of the invention;

FIG. 5 schematically illustrates a side view of an arrangement of rollers of a roller screen, according to an embodiment of the invention;

FIGS. 6 and 7 illustrate a roller sleeve and a shaft, respectively, according to an embodiment of the invention;

FIG. 8 illustrates groove and knurl patterns on roller sleeves according to an embodiment of the invention;

FIG. 9 illustrates a roller comprising a plurality of sleeves as illustrated in FIG. 8;

FIG. 10 illustrates a roller screen comprising a plurality of rollers as illustrated in FIG. 9;

FIG. 11 illustrates a variety of spacers in longitudinal cross section according to embodiments of the invention; and FIGS. 12A–12E illustrate a variety of shaft, spacer and roller configurations in transverse cross section, according to embodiments of the invention.

DETAILED DESCRIPTION OF THE INVENTION

Various embodiments of the invention are described, with reference to the accompanying drawings. The drawings are provided to clarify the description, and are not drawn to scale.

Figure 1:
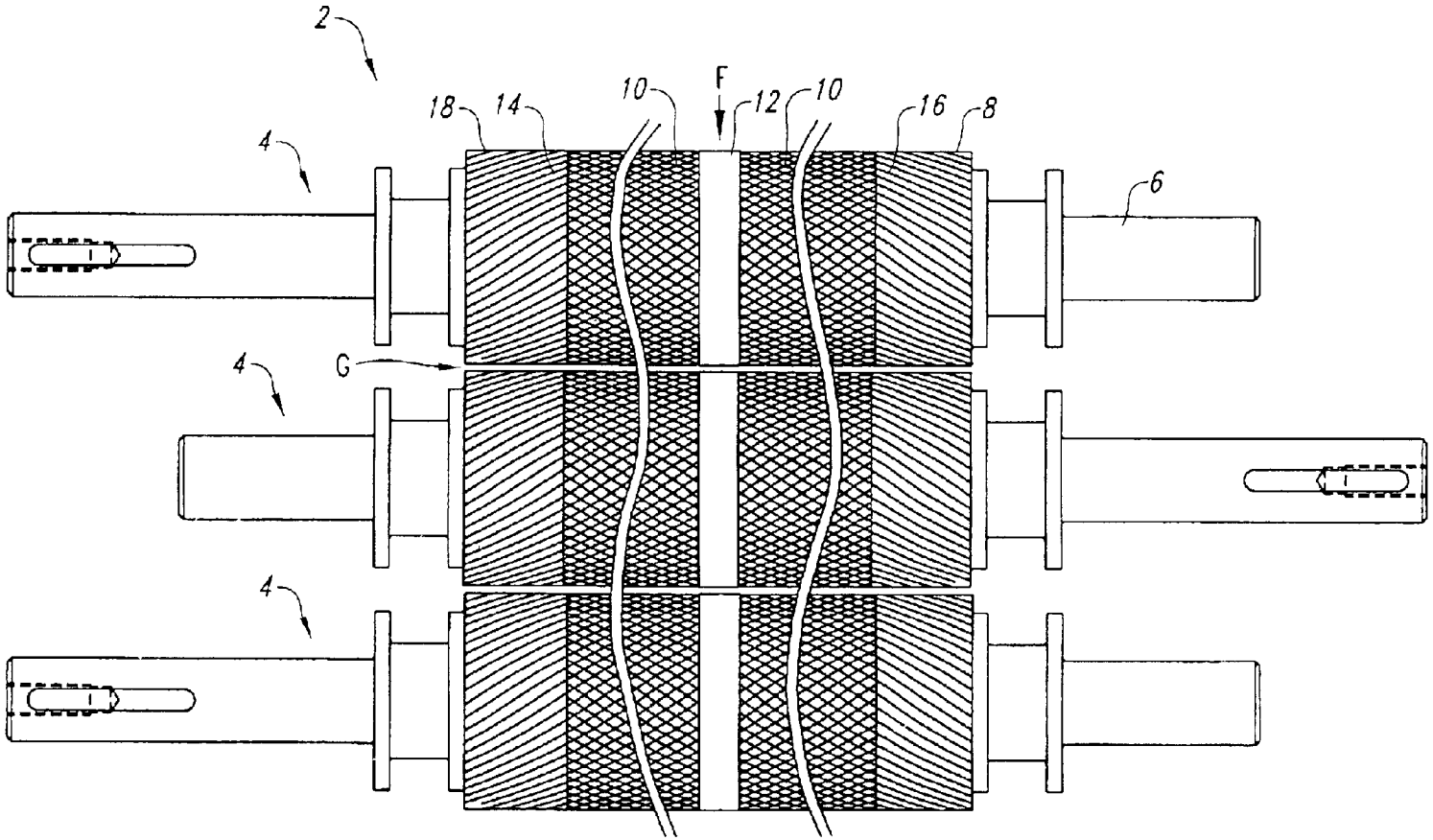
FIG. 1 shows a plan view of a portion of a roller screen, according to an embodiment of the invention.

According to an embodiment of the invention, as illustrated in FIG. 1, a roll screen bed 2 is provided, including a plurality of rollers 4. The screen portion, meaning that part of the roller that makes contact with the material to be sorted, is made up of several sections. At the center of the roller 4, the roller can have a bumper strip 12, which is a substantially smooth section having a diameter equal to, or greater than the maximum diameter of the knurled or ridged sections of the roller. Knurled sections 10 can be located on either side of the bumper strip 12. Right- and left-handed helically grooved sections 8, 14 can be positioned at the extreme ends of the screen portion.

A plurality of rollers 4 can be mounted in a parallel configuration and with a spacing appropriate to provide a desired gap G between adjacent rollers, forming, thereby, the screen bed 2. The rollers 4 can be driven by chain, belt or gear drive (not shown) and caused to rotate in the same direction. In the screen bed 2 of FIG. 1, which is pictured in plan view, the rollers 4 rotate from top to bottom, moving material downward, the flow direction being indicated by the arrow F.

Chips being processed to remove over-thick chips from acceptable chips are fed into the top portion of the bed 2, as viewed in FIG. 1. The chips are tumbled by the ridges and knurls of the rollers 4, causing them to move toward a discharge end of the bed 2. As the chips progress along the flow direction F, smaller chips pass between the rollers 4 as they tumble, and can drop into a bin or onto a second screen bed or hopper.

As the rollers 4 rotate, the right and left-hand spiral grooves 16, 18 of sections 8 and 14 exert a diagonal force on the chips (in the view of FIG. 1) and thus impart a lateral direction to the motion of the chips. For example, the right-hand spiral 16 of section 8 will tend to move material to the left. while the left-hand spiral 18 of section 14 will tend to move material to the right. This characteristic can be exploited by the right and left hand spiral sections 8 and 14 to move the chips away from the outer ends of the rollers 4, preventing the chips from falling from the ends of the rollers 4 or from interfering with the roller drive system. In this way, the need for maintenance to the drives and bearings to remove particles is reduced.

The bumper strips 12 serve to prevent the textured portions of the rollers 4 from striking together if the rollers 4 flex during operation. In the event that two adjacent rollers 4 flex sufficiently to make contact with each other, only the smooth bumper strips 12, which have a diameter equal to, or greater than the textured sections of the rollers 4, will make contact. This can prevent expensive damage to the knurls of the rollers 4, as well as reduce wear to the drive systems caused by the clash of the rollers 4. The smooth surfaces of the bumper strips 12 provide a relatively frictionless contact. Through the employment of bumper strips 12 it is possible to use longer rollers economically, and without fear of damage caused by roller strikes.

In another embodiment, the rollers 4 have regions closer to the ends of the rollers 4 that are larger in diameter than the bumper strips 12, but, since the central portion of a roller extends further from the axial line of the roller when it flexes than the portions of the roller 4 closer to the ends thereof, the bumper strip 12, at the center of the roller, will still make contact prior to the regions closer to the ends of the roller, even though those regions have a greater diameter than the bumper strip 12.

Of course, it will be understood that the lengths of the various sections of the rollers 4 will be selected according to particular requirements. For example, the spiral sections 16, 18 at each end of the rollers 4 may be shorter or longer, depending on how much material will be passing over the rollers, the speed and diameter of the rollers, the pitch and depth of the grooves, etc. Additionally, rollers 4 that are shorter than some minimum length will have no need of the bumper strips 12, inasmuch as the likelihood of strikes between rollers is related to the ratio of the length of the rollers to the diameter of the rollers. Thus, other factors affecting the maximum length of a roller not requiring a bumper strip 12 are the diameter and rigidity of the roller 4 and the gap G between rollers 4. There may be occasions in which more than one bumper strip 12 on each roller 4 is desirable, as in those cases in which the rollers 4 are of excessive length, relative to their diameter.

Figure 2:
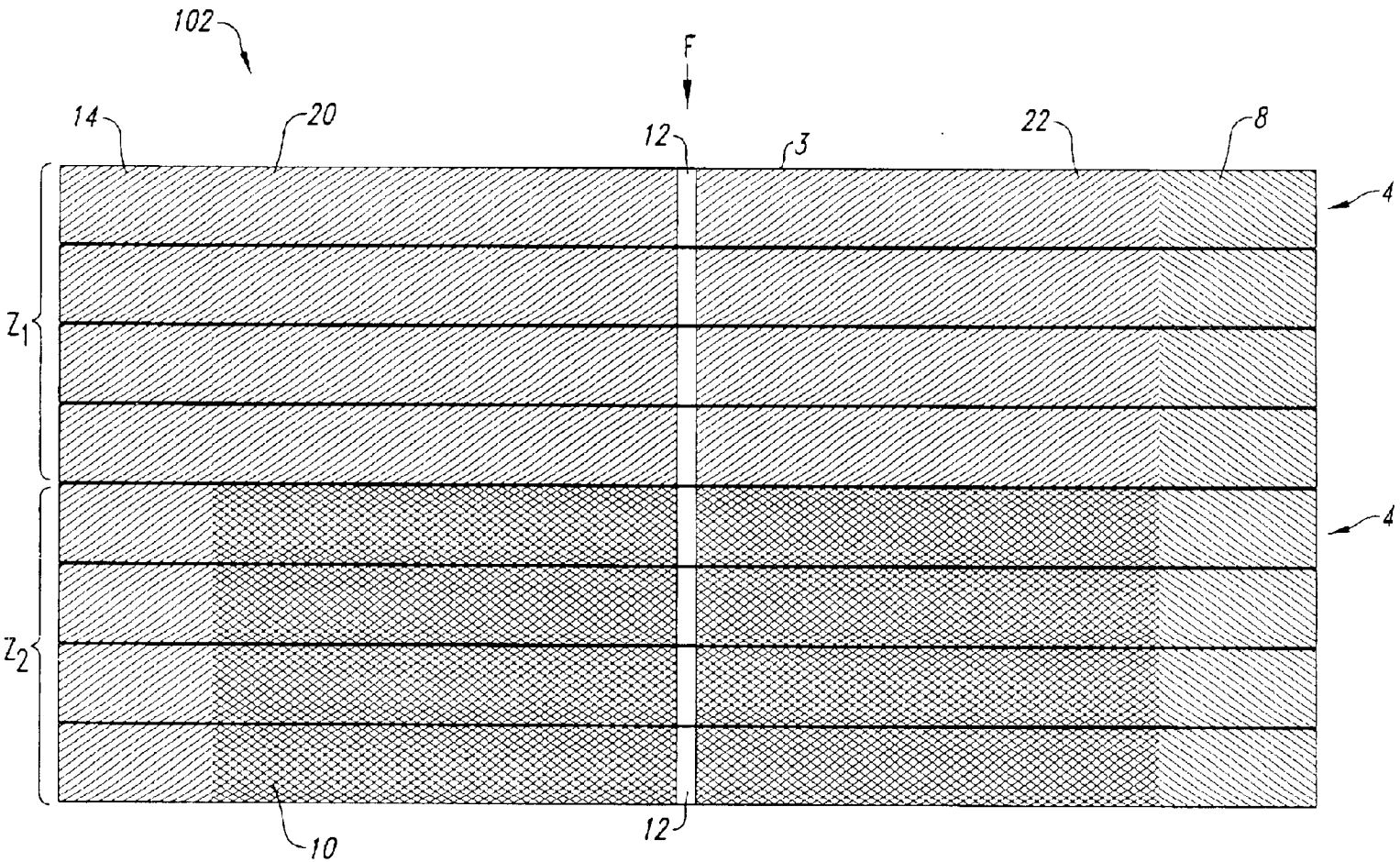
FIG. 2 shows a plan view of a portion of a roller screen, according to a second embodiment of the invention.

FIG. 2 shows a screen bed 102 employing several rollers 4 having a variety of configurations. The rollers 4 of the first group or zone $Z_1$ of rollers each have bumper strips 12 in the center followed by an inner right-hand spiral section 20 to the left of the bumper strip 12 and an inner left-hand spiral section 22 to the right of the bumper strip 12. An outer left-hand spiral section 14 is positioned to left of the inner right-hand spiral section 20, while an outer right-hand spiral section 8 is positioned to the right of the inner left-hand spiral section 22. Collectively, the inner sections 20/22 serve to disperse chips internally after they are deposited at an entry location on the roller screen 102.

The rollers 4 of the second zone $Z_2$ of rollers are configured as described with reference to FIG. 1, including knurled sections 10 between the bumper strip 12 and the right and left-handed sections 8 and 14. Wood chips in the second zone $Z_2$ tend to travel in a direction parallel to the flow direction F.

According to standard practice, with roller screen type separators, material must be distributed across the width of the bed at the inflow in order to be efficiently processed, and to prevent concentrations of material that are not properly sorted. According to the embodiment illustrated in FIG. 2, material dumped into the center of the inflow 3 at the top of the roller screen 102 will be distributed outward from the center by the action of the spiral sections 20, 22, while the reverse spirals 14, 8 at the ends of the rollers will limit the distribution to within desired limits. As the material moves across the rollers 4 of the first zone $Z_1$ of rollers it is evenly distributed to the right and left, even as the screening process proceeds. The material is then passed to the second zone $Z_2$ of rollers for additional screening, without further lateral distribution.

An advantage of this configuration is that it eliminates the need for additional machinery solely designed to distribute the material to the right and left. Instead, a conveyor belt or other conveyor system (not shown) can merely dump the material into in the center of the inflow end 3 of the bed 102 and the material will be distributed across the screen bed itself.

Figure 3:
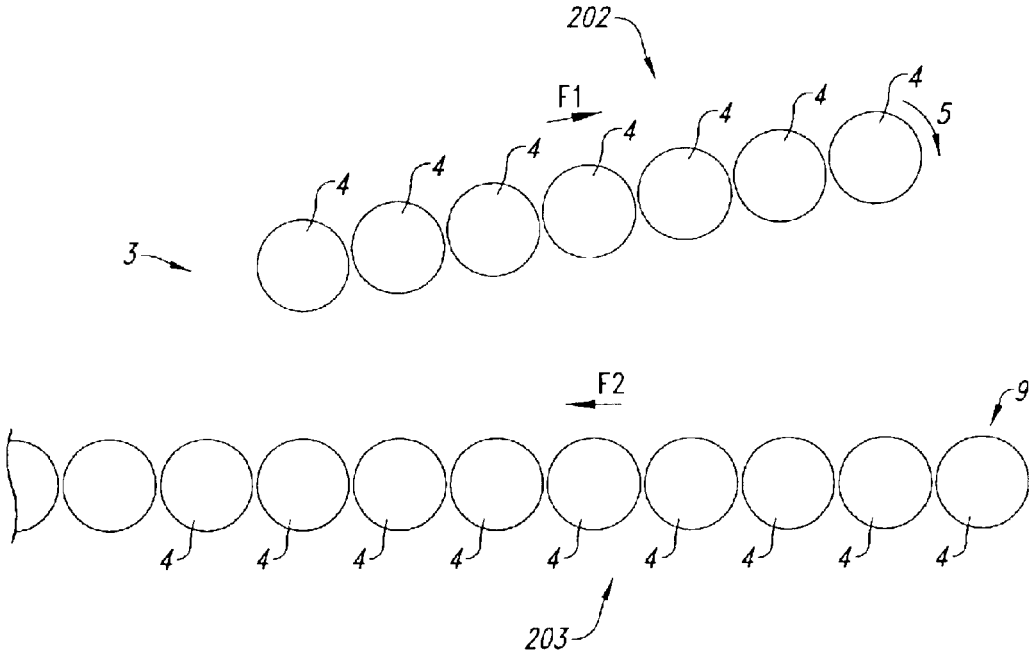
FIG. 3 is a side view schematically illustrating an arrangement of rollers of a roller screen, according to an embodiment of the invention.

An alternative of this embodiment, illustrated in FIG. 3, provides an upper screen 202, comprising rollers 4 configured like those of the first zone $Z_1$ of FIG. 2, positioned above a lower screen 203 that comprises rollers 4 configured like those of the second zone $Z_2$ of FIG. 2. In this way, material can be dumped centrally onto the upper roller screen 202 where it will be evenly distributed across the width of the screen by the lateral action of the spiral grooves of the rollers 4, and then dropped from there onto the inflow 9 of the lower screen for further sorting by the knurled rollers of the lower screen 7. In the illustrated embodiment, the upper screen 202 moves material in a direction F1 opposite the direction flow F2 of the lower screen 203, such, that with the outflow end 5 of upper screen 202 directly above the inflow end 9 of the lower screen 203, the upper screen 202 is directly above the lower screen 203. An advantage of this alternative embodiment is that it occupies less floor space, permitting its use in locations with limited space available. The angles of the upper or lower screens 2, 7 may be adjusted to increase or decrease the amount of dwell time between the rollers, which will affect the sorting characteristics of the screens 202, 203.

Because parameters and conditions vary, different situations will require different configurations. The density and content of the material to be screened will vary. Temperature and humidity will also be factors to consider. In each case, the selection of the numbers and configuration of the rollers that make up the screen bed is made to achieve the best results for that case.

For example, the number of rollers in each zone will vary. Additionally, an intermediate group or zone of rollers may be included, having knurled sections in which the right and left hand helical grooves that together form the pyramidal protrusions of the knurled rollers, are cut at different depths. The result will be a section which combines some of the advantages of knurled rollers, as described by the '988 patent cited in the background section, with a propensity to move material to the left or right, depending upon which of grooves are more deeply cut. The pitch of the grooves and spirals is selected according to specific requirements. The diameters of the rollers may be larger or smaller, or may vary at different zones of the screen bed.

FIGS. 4A–4C illustrate some of the possible knurl patterns that may be employed on the rollers 4. An economic method of forming knurls on rollers is to cut a series of helical V-shaped grooves in the roller. By cutting right-handed and left-handed grooves that crisscross each other, a knurled pattern is formed, comprising pyramidal or frusto-pyramidal knurls, according to the depth of the grooves. FIG. 4A illustrates a pattern in which the right-handed grooves 16 are cut with a shallow right-hand pitch, while the left-handed grooves 18 are cut with a very steep left-hand pitch. The result is a knurl pattern, which will have a tendency to move chip particles forward and to the left, inasmuch as the shallow right-handed grooves 16 will impart strong leftward force and almost no forward motion to material while the steep left-handed grooves 18 will impart roughly equal forward and rightward motion, the net effect being a movement to the left.

FIG. 4B illustrates an embodiment in which the left-handed grooves 18 are cut a first distance apart, and the right-handed grooves 16 are cut at the same angle but at a second, more widely spaced distance apart. The result of this knurl pattern is that as the roller rotates, the more numerous left-handed grooves will have a greater effect on the chips moving across them than will the right-handed grooves 16, resulting in a general motion toward the right.

FIG. 4C illustrates an embodiment in which the left-handed grooves 18 begin at the left side of the roller 4 at a relatively shallow angle, and as they move to the right on the roller the pitch gradually increases. Meanwhile, the right-handed grooves 16 begin at the left at a fairly high degree of pitch, reducing gradually as they move to the right. It can be seen that the degree of pitch of the right- and left-handed grooves 16 and 18 is approximately equal on the right side of the roller 4, while on the left side of the roller 4 the relative pitch is the right-hand and left-hand grooves 16 and 18 are quite different. Such a configuration is useful at the ends of a roller, where, as chip particles move toward the outside end of the roller, the relative effects of the right-hand and left-hand grooves changes, such that the chips are persuaded to move back toward the center of the roller.

FIG. 5 illustrates an embodiment in which the zones of rollers progressively increase in diameter. According to one embodiment, the first zone $Z_3$ comprises rollers 4 having the smallest diameter, for example 80 mm, $Z_4$ comprises rollers 4 having a greater diameter, such as 90 mm, $Z_5$ comprises rollers 4 having a still greater diameter, such as 100 mm and $Z_6$ comprises rollers 4 having the greatest diameter, for example 110 mm. The net effect is to create a series of rising levels or "steps" on the surface of the screen 302 whose purpose is to increase dwell time at each step and to agitate the chips and provide increasingly aggressive surfaces on which the fines may be removed. It may be advantageous to repeat the series by following the 110 mm rollers of $Z_6$ with a smaller zone such as 80 mm rollers, etc.

According to one embodiment of the invention, the roll screen is provided, in which each roller 4 is progressively larger in diameter than the previous roller. The effect of such a screen is to provide an increasingly more strenuous action on the chips as they pass across the rollers. As the chips pass over the first rollers, the fines will begin to sift out. As material is progressively sorted by the action of the screens, the remaining volume on the top of the screen reduces. By more aggressively agitating the remaining material, a more effective and complete sorting can be effected.

In another embodiment, a similar effect is achieved by progressively increasing the speed of the rollers, such that each successive roller is turning at a slightly faster rate than the previous roller. In one embodiment the reverse effect is created, in which each roller is progressively turning at a slower rate. The result of this will be that, as the material passes through the screen, the slowing of the rollers will cause the remaining material to pile up, such that the volume of material at any given point on the screen can be maintained approximately equal.

An embodiment of the invention is now described with reference to FIGS. 6 and 7, in which a roller 23 is illustrated, the outer surface of which is formed by a cylindrical sleeve or body 24. The sleeve 24 is sized to slide snugly onto an inner shaft 26 of the roller 23. In the example shown, keyways 28, 30 are formed on the interior surface of the sleeve 24 and on the outer surface of the shaft 26. A key 32, such as a woodruff key, is used to transfer rotational energy from the shaft 26 to the sleeve 24. Other methods of transferring rotational energy include forming the shaft 26 in a shape other than cylindrical—hexagonal, for example—and forming the interior opening of the sleeve 24 to mate with the shaft (see, for example, FIG. 12C). A setscrew may also be employed, either to prevent the sleeve 24 from sliding along the shaft 26, or also to transfer rotational energy. Those skilled in the art will understand that there are other energy transfer methods to accomplish these tasks, all of which are considered to be within the scope of the invention.

The outer surface 34 of the sleeve 24 is formed in the manner described with reference to the rollers 4 of FIGS. 1–4. The surface may have a spiral groove formed therein, a knurled surface or a smooth surface. The sleeves 24 may be made having knurls of a variety of sizes and shapes. Spiral grooves may be deep or shallow, having any pitch desired. The pitch may me made to vary along the length of the sleeve 24. The sleeve 24 may have a length equivalent to the width of a screen bed, or the length of the sleeve 24 may be equal to one of the sections, 8, 10, 12 or 14, described with reference to FIGS. 1–4. The employment of sleeve sections provides a means for replacing worn or damaged sections of a roller without the time, expense or waste of replacing the entire roller.

According to one embodiment of the invention, as pictured in FIG. 8, the sleeve sections 38 are formed in standard lengths, each having one of a variety of possible surface textures, as previously described. Pictured in FIG. 8 are a right-hand spiral section 44, a left-hand spiral section 46, a knurled section 48 and a bumper strip section 50, which is shown as a shorter section.

As illustrated in FIG. 9, a roller 40 is formed of several sections of sleeve 38 on a single shaft 26, assembled according to the requirements of a particular application.

The roller 40 pictured in FIG. 9 includes eight standard length sections 38 plus a bumper strip 50. The bumper strip 50 may be integral with the shaft 26, providing, thereby, a way of properly aligning the sections 38, or it may be a shorter sleeve section 50 on the shaft. The bumper strip may also be formed as an integral part of a standard length sleeve section 38, avoiding, thereby, adding length to the roller 40.

The bumper section 50 may be made from a different material than the other sections 38 of the roller 40. For example, the knurled and grooved sections 38 may be made from alloys, molded nylon, hardened or chrome plated steel, or other suitable materials, to improve wear characteristics, while the bumper section 50 may be made from alloys, composite material, nylon or other polymers, to improve tolerance to the impact of a roller strike and to reduce friction.

The length of the standard sleeve sections 38 may be selected such that the same size sleeve 38 is usable on any of several standard length rollers 40. Thus, for example, if 12 inches is a standard section length, a roller 40 having a working length of 72 inches may be formed using six standard sleeves 38, while a roller 40 having a working length of 96 inches may be formed using eight standard sleeves 38. Because the sleeves are interchangeable, a roller may be easily configured to conform to a wide range of requirements without the expense of a complete roller that can't be reconfigured. Thus, an inventory of sections 38 capable of being assembled into rollers of a wide variety of sizes and types may be maintained at a reduced cost.

FIG. 10 illustrates a screen bed 42 assembled from sections 38 and rollers 40. The sorting characteristics of the screen bed 42 are identical to those of the screen bed 102 pictured in FIG. 2, including a first zone $Z_1$ having sections of right and left-hand spiral grooves, and a second zone $Z_2$ having knurled sections, with right and left-hand grooved sections on the ends only.

With reference to the sleeve 24 and shaft 26, as described and pictured in FIGS. 6 and 7, the sleeve 24 and shaft 26 may be made to slide snugly together, or the sleeve 24 may have an inner diameter that is substantially greater than the outer diameter of the shaft, in which case a spacer 36 may be used to maintain the sleeve 24 on the shaft 26. The use of a spacer 36 may offer several advantages. By providing space between the sleeve 24 and the shaft 26, the overall weight of the roller can be reduced, as compared to a roller of equal length and diameter having a solid shaft 26 and a sleeve 24 that fits snugly thereon. Additionally, a shaft designed to accommodate smaller diameter sleeves 24 may also be made to support sleeves 24 having larger diameters by using different spacers 36. The actual assembly of a roller 40 will be easier, inasmuch as the area generating friction as a sleeve 24 is moved onto a shaft 26 is reduced to the length of the spacer 36, rather than the entire length of the sleeve 24. A tendency to bind, which can occur when assembling long parts having close tolerances, is eliminated, since the spacer 26 will have a length of not more than a few inches.

FIG. 11 shows a longitudinal cross sectional view of a series of sleeve sections 38 on a shaft 26, in which several embodiments of spacers are illustrated. Spacer 36*a* has a portion that extends beyond the end of the section 38, which bears against the section 38, holding it in lateral position. A setscrew 34 can engage a groove 35 formed in the shaft 26 for that purpose. A spacer similar to 36*a* at each end of a roller 40 can hold all the sections 38 of the roller 40 in their proper lateral positions, without the need of additional setscrews or other locking devices along the length of the roller. Spacer 36*b* is configured to engage shoulders in contiguous sections 38 to maintain the spacer 36*b* in the proper position between adjacent sections 38. Spacer 36*c* incorporates a bumper strip 12 having a diameter equal to or greater than adjoining sections 38. The end of a section 38 rests on a smaller diameter portion of the spacer 36*c* on either side of the bumper portion 12. Shoulders 52 on the interior surface of the sections 38 may be employed, but are not essential, inasmuch as the presence of the bumper strip 12 will serve to maintain the components in proper position. Spacer 36*d* does not employ shoulders on either the spacer 36*d* or sections 38. Consequently, other means for fixing the spacer 36*d* and the section 38 are required. A setscrew 34 is pictured in FIG. 11, passing through an aperture 54 in the section 38 and the spacer 36*d* to bear against the shaft 26. The embodiments pictured in FIG. 11 are shown as examples of the many possible types of spacers. Those skilled in the art will recognize other effective profiles that may be employed.

Also illustrated in FIG. 11 is an end unit 63. According to an embodiment of the invention, an end unit 63 is threaded onto the shaft 26 at each end 60 thereof. FIG. 11 shows an end unit 63 having an aperture 70 with internal threads 64. The shaft end 60 has external threads 62, which engage the threads 64 of the end unit 63, drawing the end unit 63 onto the shaft 26. shoulder regions 66 are biased against the sleeve section 38, which will tend to tighten the sleeve sections 38 against each other. An integrated spacer 68 may be incorporated with the end unit 63, or another type of spacer may be employed, in those embodiments where a spacer is required. Roller bearings and the drive mechanism (not shown) are coupled to the end unit 63. It will be understood that the hand of the threads may be selected such, that the action of the rollers will tend to tighten the threaded joint between the end unit 63 and the shaft end 60. It will also be understood that, instead of threading a portion of the shaft end 60 into an aperture in the end unit 63, the shaft end 60 may incorporate a threaded aperture into which a portion of the end unit is threaded.

Figure 12A:
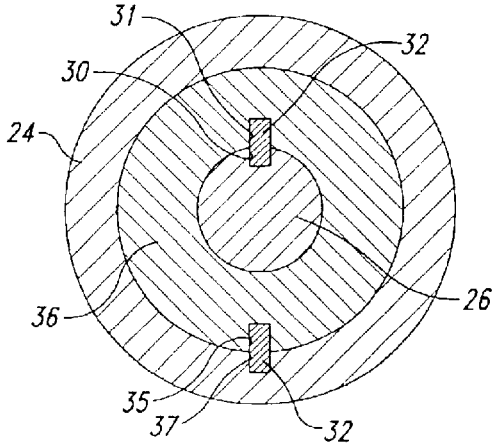

FIGS. 12A–12E show, in cross sections taken perpendicular to the axis of a roller, a series of embodiments for transferring rotational energy from the shaft 26, through the spacer 36, to the sleeve 24. FIG. 12A shows a shaft 26 having a keyway 30 aligned with a keyway 31 in the spacer 36. A woodruff key 32 transfers rotational energy from the shaft 26 to the spacer 36. A keyway 35 in the outer rim of the spacer 36 aligns with a keyway 37 in the inner surface of the sleeve 24 with a woodruff key 32 therebetween to transfer the rotational energy from the spacer 36 to the sleeve 24.

Figure 12B:
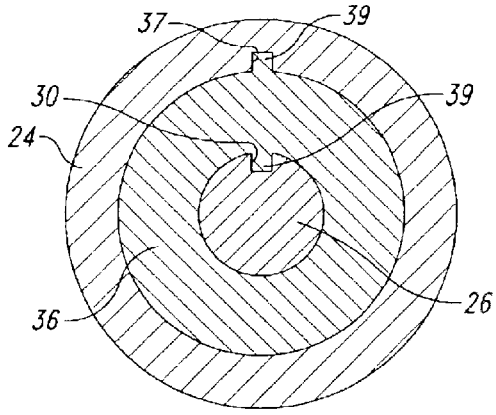

FIG. 12B is similar to the embodiment of FIG. 12A insofar as the shaft 26 and sleeve 24 each have keyways 30 and 37, but the spacer 36 of FIG. 12B has features 39 configured to mate with the keyways 30, 37 of the shaft 24 and the sleeve, obviating the need for keys. The keyways and features could be reversed without deviating from the invention.

Figure 12C:
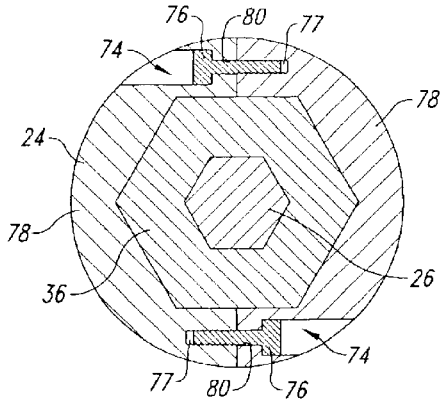

FIG. 12C shows a shaft 26 having a hexagonal cross section, onto which a spacer 36, having an aperture sized and shaped to mate with the shaft 26, is placed. The outer surface of the spacer 36 also has a hexagonal cross section, which mates with the inner surface of the sleeve 24. The exact shapes of the elements can vary dramatically, so long as they are not circular, without deviating from the spirit of the invention.

FIG. 12C also illustrates an embodiment in which the sleeve 24 is in sections 78, which are assembled around the shaft 26 and spacer 36. Bolts 76 pass through apertures 80 in the respective semi-cylindrical segments 78 and engage threaded apertures 77 in the opposite segments 78. This embodiment permits removal and replacement of individual sleeve sections 24 without disassembly of a screen bed or roller.

Figure 12D:
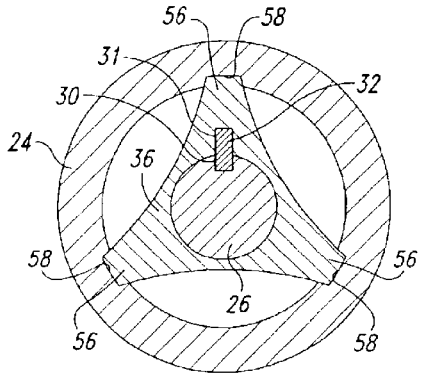

FIG. 12D shows a spacer 36 having a triangular cross section. The extremities 56 of the triangular spacer 36 engage grooves 58 on the interior surface of the sleeve.

Figure 12E:
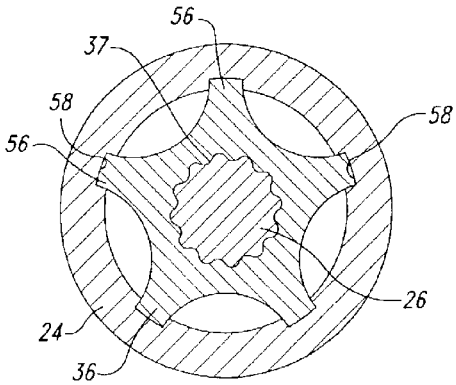

FIG. 12E shows a shaft 26 having a fluted surface, the aperture 37 in the spacer 36 having flutes to match those of the shaft 26. The spacer 36 has a stellate shape in cross section, the extremities 56 of which engage grooves 58 in the interior surface of the sleeve 24, as in the embodiment of FIG. 12D. As illustrated in FIGS. 12D and 12E, the exact shape and number of extremities of the spacer can vary without deviating from the scope of the invention.

It will be recognized that those embodiments illustrated in FIGS. 12A–12E for linking shaft 26, spacer 36 and sleeve 24 may easily be adapted for linking the shaft 26 directly to the sleeve 24 in those embodiments in which no intervening spacer is employed.

The various embodiments of the invention have been described with reference to the sorting and separation of woodchips and fines. However, roller screens and sorting devices are used in a wide variety of industries and processes. For example, embodiments of the invention may be applied in sorting and grading mineral materials such as rock or coal. In agriculture, roller screens are used for sorting and grading many different products, including potatoes and peppers. Such applications are considered to be within the scope of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A sleeve for a roller screen having a shaft, the sleeve comprising:

a cylindrical body;

means for transferring rotational torque from the shaft to the body, the rotation occurring transverse to an axis of the sleeve; and means for transferring kinetic energy from the body to material in contact with an outside surface of the sleeve.

2. The device of claim 1 wherein the torque transferring means comprises a keyway formed in an inner surface of the cylindrical body.

3. The device of claim 1 wherein the torque transferring means comprises a threaded aperture passing from an outer surface to an inner surface of the cylindrical body and configured to receive a setscrew.

4. The device of claim 1 wherein the torque transferring means comprises a shape of an outer surface of the shaft, other than cylindrical, and a shape of an inner surface of the cylindrical body conforming to the shape of the shaft.

5. The device of claim 1 wherein the energy transferring means comprises left hand spiral grooves formed in an outer surface of the cylindrical body.

6. The device of claim 1 wherein the energy transferring means comprises right hand spiral grooves formed in an outer surface of the cylindrical body.

7. The device of claim 1 wherein the energy transferring means comprises left and right hand spiral grooves formed in an outer surface of the cylindrical body and crisscrossing each other.

8. The device of claim 7 wherein the spiral grooves of one hand are formed more deeply than the grooves of the other hand.

9. The device of claim 1 wherein the cylindrical body comprises a plurality of semi-cylindrical segments configured to be coupled together around the shaft.

10. The device of claim 1 wherein the cylindrical body is formed from a polymer.

11. The device of claim 10 wherein the cylindrical body is formed from nylon.

12. A roller having a shaft, for sorting material according to physical dimensions, comprising:

a cylindrical sleeve configured to be captively coupled to an outer surface of the shaft;

a first region of the sleeve having a left hand spiral groove; and a second region of the sleeve having a right hand spiral groove.

13. The roller of claim 12 wherein the cylindrical sleeve further comprises a smooth region between the first and second regions, the smooth region having an outside diameter equal to or greater than outside diameters of the first or second regions.

14. The roller of claim 12 wherein the shaft is positioned within, and coaxial to, the cylindrical sleeve.

15. The roller of claim 14 wherein the shaft is sized to fit snugly within the cylindrical sleeve.

16. The roller of claim 15 wherein the cylindrical sleeve is locked to the shaft via first and second keyways formed in an interior surface of the sleeve and an outer surface of the shaft, respectively, and wherein the first and second keyways are configured to receive between them a locking key to transfer rotational energy from the shaft to the sleeve.

17. The roller of claim 14 wherein an outer diameter of the shaft is substantially less than an inner diameter of the cylindrical sleeve.

18. The roller of claim 17 wherein the shaft and the cylindrical sleeve are maintained in a coaxial relationship by an intermediate spacer positioned in a space between the outer surface of the shaft and the inner surface of the sleeve.

19. A roller screen, comprising:

a roller configured to rotate along an axis thereof;

left-hand spiral grooves formed in a first region of an outer surface of the roller, the first region extending longitudinally from a first end of the roller toward the center of the roller; and right-hand spiral grooves formed in a second region of an outer surface of the roller, the second region extending longitudinally from a second end of the roller toward the center of the roller.

20. The device of claim 19, further comprising right- and left-hand spiral grooves crisscrossing one another, formed in a third region extending between the first and second regions.

21. The device of claim 19, further comprising:

right-hand spiral grooves formed in a third region extending between the first region and the center of the roller, longitudinally; and left-hand spiral grooves formed in a fourth region extending between the second region and the center of the roller, longitudinally.

22. The device of claim 19, further comprising a smooth region devoid of grooves formed in a third region extending between the first and second regions.

23. The device of claim 19 wherein an outer region of the roller comprises a cylindrical sleeve mated to an inner shaft, the grooves of the first and second regions being formed in an outer surface of the sleeve.

24. The device of claim 19 wherein an outer region of the roller comprises a plurality of cylindrical sleeves mated to an inner shaft, each of the sleeves comprising one of the first and second regions.

25. A device, comprising:

a shaft configured to rotate in a direction transverse to an axis thereof;

a first cylindrical sleeve positioned coaxially with the shaft and coupled thereto such that rotational energy of the shaft is imparted to the sleeve;

features formed on an outer surface of the sleeve and configured to impart kinetic energy from the sleeve to objects in physical contact with the sleeve.

26. The device of claim 25 wherein the features comprise left-hand spiral grooves.

27. The device of claim 25 wherein the features comprise right-hand spiral grooves.

28. The device of claim 25 wherein the features comprise right- and left-hand spiral grooves crisscrossing each other to form knurls on the surface of the sleeve.

29. The device of claim 28 wherein the left-hand grooves are deeper than the right-hand grooves.

30. The device of claim 25, further comprising a second cylindrical sleeve positioned coaxially with the shaft and having a smooth outer surface and an outside diameter equal to or greater than an outside diameter of the first cylindrical sleeve.

31. The device of claim 25 wherein the first cylindrical sleeve is one of a plurality of cylindrical sleeves positioned coaxially with the shaft and coupled thereto such that rotational energy of the shaft is imparted to each of the plurality of sleeves, and wherein each of the plurality of sleeves includes features configured to impart kinetic energy to objects in physical contact thereto.

32. The device of claim 31 wherein each of the plurality of cylindrical sleeves is of equal length.

33. The device of claim 25, further comprising an end unit configured to be coupled to an end of the shaft, and further configured to maintain the first cylindrical sleeve in position on the shaft, longitudinally.

34. A roller screen, comprising:

a plurality of rollers positioned in a side-by-side relationship with a selected gap therebetween, the rollers configured to rotate in a common direction;

a right-hand end of each of the plurality of rollers having features configured to impart a generally leftward motion to objects in physical contact therewith; and a left-hand end of each of the plurality of rollers having features configured to impart a generally rightward motion to objects in physical contact therewith.

35. A roller screen, comprising:

a plurality of rollers positioned in a side-by-side relationship with a selected gap therebetween, the rollers configured to rotate in a common direction, each of the plurality of rollers having features configured to impel objects in contact therewith in the direction of rotation; and a central region of each of the plurality of rollers having a smooth surface, wherein the central regions of adjacent rollers are configured such that, in the event that two adjacent rollers flex sufficiently to make contact, the smooth central regions touch prior to any other part of the rollers.

36. A roller screen, comprising:

a plurality of rollers positioned in a side-by-side relationship with a selected gap therebetween, the rollers configured to rotate in a common direction; and a cylindrical sleeve positioned coaxially with and coupled to one of the plurality of rollers such that the sleeve rotates with the one of the rollers, an outer surface thereof having features configured to impel objects in contact therewith in the direction of rotation.

37. The screen of claim 36 wherein the cylindrical sleeve is one of a plurality of cylindrical sleeves positioned coaxially with and coupled to the one of the plurality of rollers.

38. The screen of claim 36 wherein the cylindrical sleeve is one of a plurality of cylindrical sleeves, each positioned coaxially with and coupled to a corresponding one of the plurality of rollers.

39. A method of sorting wood chip material by physical dimension, comprising:

feeding the material at an infeed end of a roller screen having agitating and conveying rollers spaced apart to allow objects smaller than a selected dimension to fall between;

moving the material across the screen from the infeed end in a direction transverse to the axes of the rollers by rotating the rollers in a common direction toward an outflow end of the roller screen; and shifting chips that approach to within a selected distance from the ends of the rollers inward toward a central region of the screen, the shifting step being performed by the action of helical grooves at the ends of each of the rollers, the hand of each of the grooves being selected to shift material to the left or the right as required, given the direction of rotation of the rollers.

40. The method of claim 39 wherein the moving step comprises distributing material outward from the central region toward the ends of the rollers, the distributing step being performed by helical grooves in the central region between the ends of each of the rollers but not extending beyond the selected distance from the ends of each of the rollers, the hand of the helical grooves in the central region of each of the rollers being selected to distribute the material to the right or the left as required.

41. A roller for sorting material according to physical dimensions, comprising:

an outer surface configured to receive, thereon, material to be sorted;

a left hand spiral groove formed in the outer surface; and a right hand spiral groove formed in the outer surface, the right hand spiral groove having at least one characteristic that is not identical with respect to the left hand spiral groove.

42. The roller of claim 41 wherein the characteristic is chosen from among pitch, depth of the groove, or variation of pitch along a longitudinal portion of the roller.

43. A roller for sorting material according to physical dimensions, comprising:

an outer surface configured to receive, thereon, material to be sorted;

a spiral groove formed in the outer surface; and a smooth region encompassing a circumference of a central portion of the roller, the smooth region having an outside diameter equal to or greater than a portion of the roller having the spiral groove.

* * * * *